US006382143B2

(12) United States Patent
Taurozzi

(10) Patent No.: US 6,382,143 B2
(45) Date of Patent: May 7, 2002

(54) BALANCED MODULAR PENDULUM MECHANISM

(76) Inventor: Eduardo Taurozzi, Rio Negro 943, Bella Vista (AR)

( * ) Notice: Subject to any disclaimer, the term of this patent is extended or adjusted under 35 U.S.C. 154(b) by 0 days.

(21) Appl. No.: 09/848,444

(22) Filed: May 3, 2001

(30) Foreign Application Priority Data

May 4, 2000 (AR) ..... P 00 01 02163

(51) Int. Cl.[7] ..... F02B 53/00
(52) U.S. Cl. ..... 123/18 A; 123/18 R; 123/241
(58) Field of Search ..... 123/18 R, 18 A, 123/241; 92/120

(56) References Cited

U.S. PATENT DOCUMENTS 1,256,647 A * 2/1918 Baudot ..... 123/18 A X
2,416,846 A * 3/1947 Richter ..... 123/18 A
2,651,206 A * 9/1953 Veille ..... 123/18 A X
3,910,239 A * 10/1975 James ..... 123/18 R

FOREIGN PATENT DOCUMENTS

AR 207194 9/1976

* cited by examiner

*Primary Examiner*—Hoang Nguyen
(74) *Attorney, Agent, or Firm*—Emrich & Dithmar

(57) ABSTRACT

The present invention relates to a balanced pendulum mechanism that is useful in devices such as vacuum pumps, compressors, engines and blowers. The mechanism includes a pair of toroidal shaped cylinders originating from the centerline of a central axis, with each cylinder structurally arranged to receive and cooperate with a plunger attached to a pendulum arm that is pivotally anchored to the central axis. The pendulum arms are linked to connecting rods mounted to the crankshaft to complete the pendulum mechanism which is operable with or without lubrication.

23 Claims, 4 Drawing Sheets

BALANCED MODULAR PENDULUM MECHANISM

FIELD OF THE INVENTION

The present invention relates to a mechanism that may be used in different type machines. More particularly, the present invention comprises a balanced modular pendulum mechanism which may be applied to devices such as vacuum pumps, compressors, engines and blowers and which may operate either with or without lubrication, rendering a high yield while operating in a well balanced manner.

BACKGROUND OF THE INVENTION

Among the conventional rotating mechanisms presently used in compressors, the most commonly used mechanisms are those of the rotating screw type. Such rotating mechanisms have replaced alternating lubricated compressor mechanisms because they require less servicing while their size is smaller. Moreover, conventional alternating mechanisms are lubricated with mineral oil, which is a drawback due to oil carbonization within the valves, so monitoring, servicing and maintenance tasks and expenses are highly increased with such structures.

Also, rotating compressor mechanisms have a significant drawback, for they are heavy energy consumers. Thus, the energy consumption remains high when the machine works at full capacity and when it works in vacuum. Also, oil servicing and oil filter replacement are necessary during operation of the compressor which increase operating costs of such rotating compressor mechanisms.

In the past, the present inventor has developed mechanisms for engines or compressors based on a different arrangement: a toroidal cylinder and a plunger of wider diameter, but more flattened than those of a conventional type mechanism.

These novel mechanisms have been successfully used in compressors, in different types of vehicles and in engines in general. In such cases, proper functioning has resulted, consumption of energy has been reduced, pollution has been reduced, and neither constructive or arrangement problems have arisen during operation. Such a device is described in Argentinean Patent No. 207194, issued to the inventor of the present application.

However, because such a structure mechanism is a two-effect mechanism, the movable parts are heavier. Accordingly, such a mechanism may not reach high speeds. This is due to the fact that two plungers or pistons are attached to a simple pendulum member, thereby requiring a higher inertial force to be generated by the single connecting rod, bolts and crankshaft to move the structure mechanism and maintain the double plungers in operating position.

SUMMARY OF THE INVENTION

The present invention fulfills the requirements of modem technologies where there is a need for low weighted compressors and engines which provide smooth and silent operation. Also, it is desirable that such mechanisms operate at high revolutions to provide increased efficiency while reducing the size of the mechanism to reduce the costs of operation.

In order to meet these requirements, a double pendulum mechanism has been developed, in accordance with the present invention. The present invention relates to a balanced pendulum mechanism that is useful in devices such as vacuum pumps, compressors, engines and blowers. The mechanism includes a pair of toroidal shaped cylinders originating from the centerline of a central axis, with each cylinder structurally arranged to receive and cooperate with a plunger attached to a pendulum arm that is pivotally anchored to this central axis. The pendulum arms are linked to connecting rods mounted to the crankshaft to complete the pendulum mechanism which is operable either with or without lubrication.

Accordingly, the present invention contemplates that the central axis may be a single axis which pivotally anchors the pendulum arms for cooperation with the toroidal shaped cylinders. However, it is within the scope of the present invention that each toroidal shaped cylinder may have its' own associated central axis positioned within the housing block which pivotally anchors a pendulum arm for cooperation with each respective toroidal cylinder. Accordingly, a geometrical relation exists between a respective cylinder and its' respective central axis because the generation centerline axis of the cylinder coincides with it's own mounting central axis for the pendulum arm.

When the pendulum mechanism is applied to a traditional pendulum compressor, revolutions and air generation are doubled and, in some instances, is tripled. The reason for this increased efficiency is that in accordance with the present invention, the weight and volume of the components of the mechanism are reduced, the operation of the mechanism is highly balanced, and the mechanism is not subject to strong mechanical efforts due to the effect of inertia. Also, the present invention exceeds the operation of conventional rotating compressors because of low energy consumption while providing high air pressure generation. The present invention also provides increased efficiency when working with less than a full load. And, during operation, the temperature of the plunger and the cylinder is substantially reduced to provide the ecological benefit of eliminating burnt oil passing into the environment.

Because the present pendulum mechanism may operate either with or without the use of lubricants, it is especially suitable for being employed in hospitals, food factories, medicine plants, textile industries, wood industrialization, plastic elaboration plants and in many other applications. For example, it may be used in nuclear reactors and for railway purposes.

Finally, the present pendulum mechanism is modular so that many units can be arranged radially around a single crankshaft, one after the other aligned axially along the crankshaft, or several units may share the same engine block.

Finally, the various parts of the present invention may fit several applications. For example, the toroidal shaped cylinders and plungers may have different diameters and the mounting axes of the pendulum arms may or may not be coaxial. Also, the valve devices for use with the cylinder may be positioned in the head of the toroidal shaped cylinder, in the plunger or both as desired. For the sake of clarity in the present description, the word cylinder does not refer to a specific geometric shape, but to the part of an engine where the combustion of a high carbon mixture occurs or where either a vapor or other fluid enters by pressure so as to energize the plunger or piston member that makes the drive shaft move by means of the connecting rod. In the case of a compressor, reference is made to the chamber where the plunger operates to cause compression.

DESCRIPTION OF THE DRAWINGS

The objects and advantages of the present invention will be better appreciated when taken in consideration with the several drawings, wherein a preferred embodiment is depicted, merely for illustrative purposes and not limited in any sense.

In the different views, the same reference numerals apply to the same or similar parts, while letters have been used for designating any arrangement of several of the elements.

Figure 1:
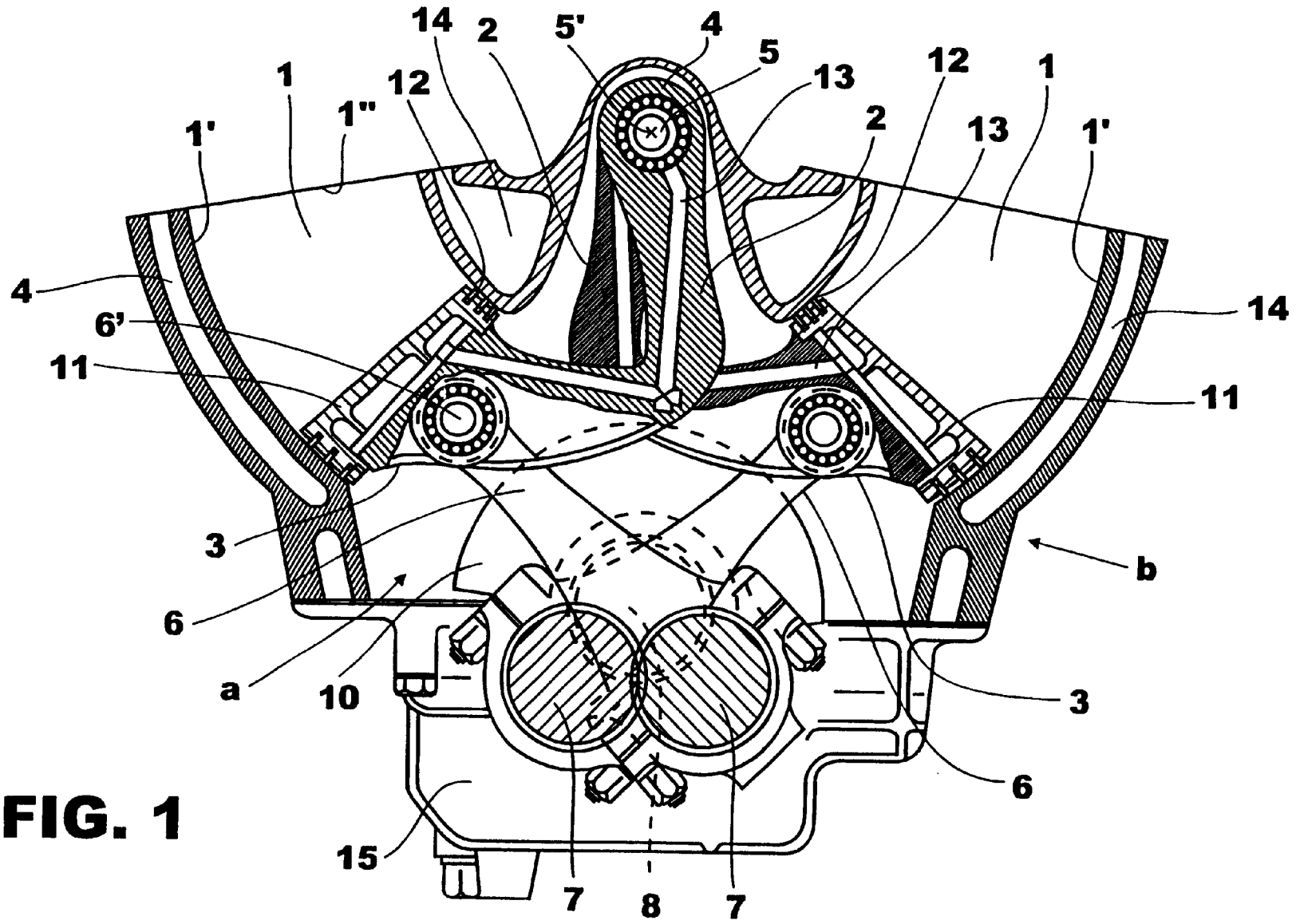
FIG. 1 is a longitudinal section of the pendulum mechanism in accordance with the present invention.

REFERENCE NUMERALS IN THE DRAWINGS (a) Modular arrangement (b) Block

Valve device for operation as combustion engine

(1) Toroidal cylinders

(1') Side walls of toroidal cylinders

(1") Heads of toroidal cylinders

(2) Pendulum arms

(3) Movable ends of pendulum arms

(4) Rotating ends of pendulum arms

(5)Mounting central axis of pendulum arm

(5') Virtual (centerline) axis around which cylinders (1) are oriented

(6) Connecting rods

(6') Linkage between pendulum arms and connecting rods

(7) Bearing journals

(8) Crankshaft

(10) Counterweights of bearing journals

(11) Plungers (pistons)

(12) Plunger rings

(13) First cooling line of plungers

(14) Second cooling line of cylinders

(15) Oil crankcase

(20) Feeding line of valve device

(21) Exhaust line of valve device

(22) Fuel inlet valves

(23) Fuel exhaust valves

(24) First intake camshaft

(25) Second exhaust camshaft

DESCRIPTION OF THE EMBODIMENT

The present invention relates to a balanced pendulum mechanism that is usefull in devices such as vacuum pumps, compressors, engines and blowers. In one embodiment of the present invention, the mechanism includes a pair of toroidal shaped cylinders originating from the centerline of a central axis, with each cylinder structurally arranged to receive and cooperate with a plunger attached to a pendulum arm that is pivotally anchored to the central axis. The pendulum arms are linked to connecting rods mounted to the crankshaft to complete the pendulum mechanism which is operable either with or without lubrication.

Specifically, in one embodiment of the present invention, as shown in FIG. 1, the pendulum mechanism is a double mechanism, comprising a modular arrangement (a) having a housing block (b) which includes two toroidal shaped cylinders 1, two pendulum arms 2 having plungers or pistons 11 attached to the swinging end of the arms 2 and two connecting rods 6 applied to a respective crankshaft 8.

More particularly, the two cylinders 1 are symmetrically arranged and positioned on each side of the block (b). Each cylinder 1 has a toroidal shaped section and is geometrically located or arranged around a virtual or centerline axis 5' of a mounting axis 5. The virtual or centerline axis 5' of the centered mounting axis 5 mates the pendulum arm 2 with the cylinder 1 which is structurally arranged to cooperate with the cylinder 1. The pendulum arm 2 is, preferably, a square arm, which, on one side, ends in a rotating end 4 secured on the mounting axis 5 thereof, and, on the other side, ends in a movable end 3 having a plunger or piston 11 mounted thereon which is structurally arranged to move back and forth within the cylinder to compress a gas, create a vacuum or function as a combustion engine. Also, it is within the scope of the present invention that when plunger 11 is a separate part which is mounted on the movable end 3, other shapes may be used wherein the plunger 11 is formed by the movable end 3 of the pendulum arm 2.

Figure 2A:
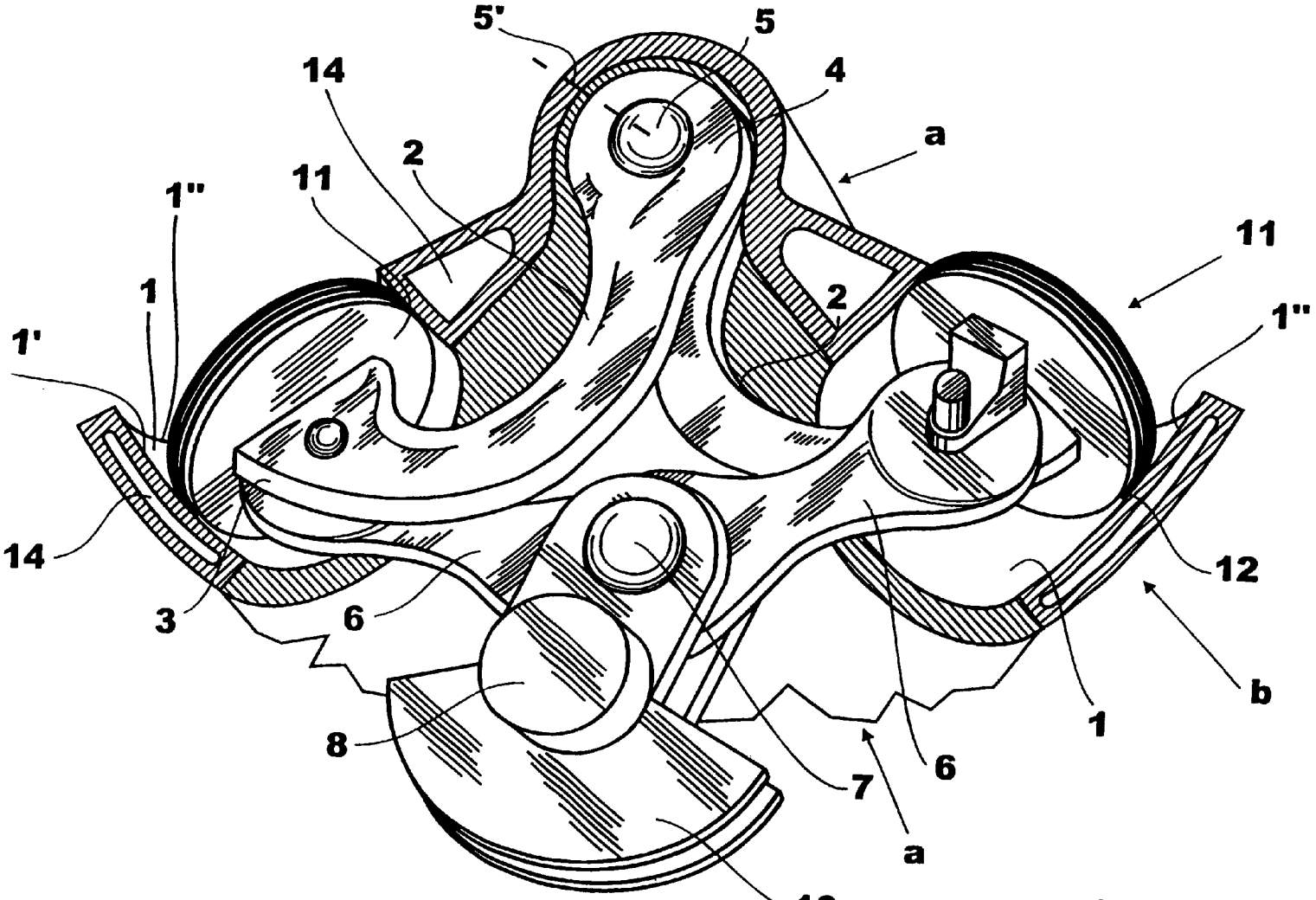
FIG. 2*a* is a longitudinal section of the engine block in accordance with the present invention.

Each movable end 3 and the respective plunger or piston 11 moves along a swinging path in its corresponding toroidal shaped cylinder 1, as shown in FIG. 2*a*. The plunger 11 is maintained separated from and equidistant to the walls 1' of the respective cylinder 1, and piston rings 12 are mounted on the outside circumferential edges of the plunger, to make sliding, sealing type contact with the toroidal walls 1' of the cylinder 1.

Adjacent the plunger 11, each movable end 3 of the pendulum arm 2 has a linkage 6' connecting the arm 2 to a connecting rod 6. The connecting rod 6 is mounted on a bearing journal 7 of a crankshaft 8 having a counterweight 10.

Figure 2B:
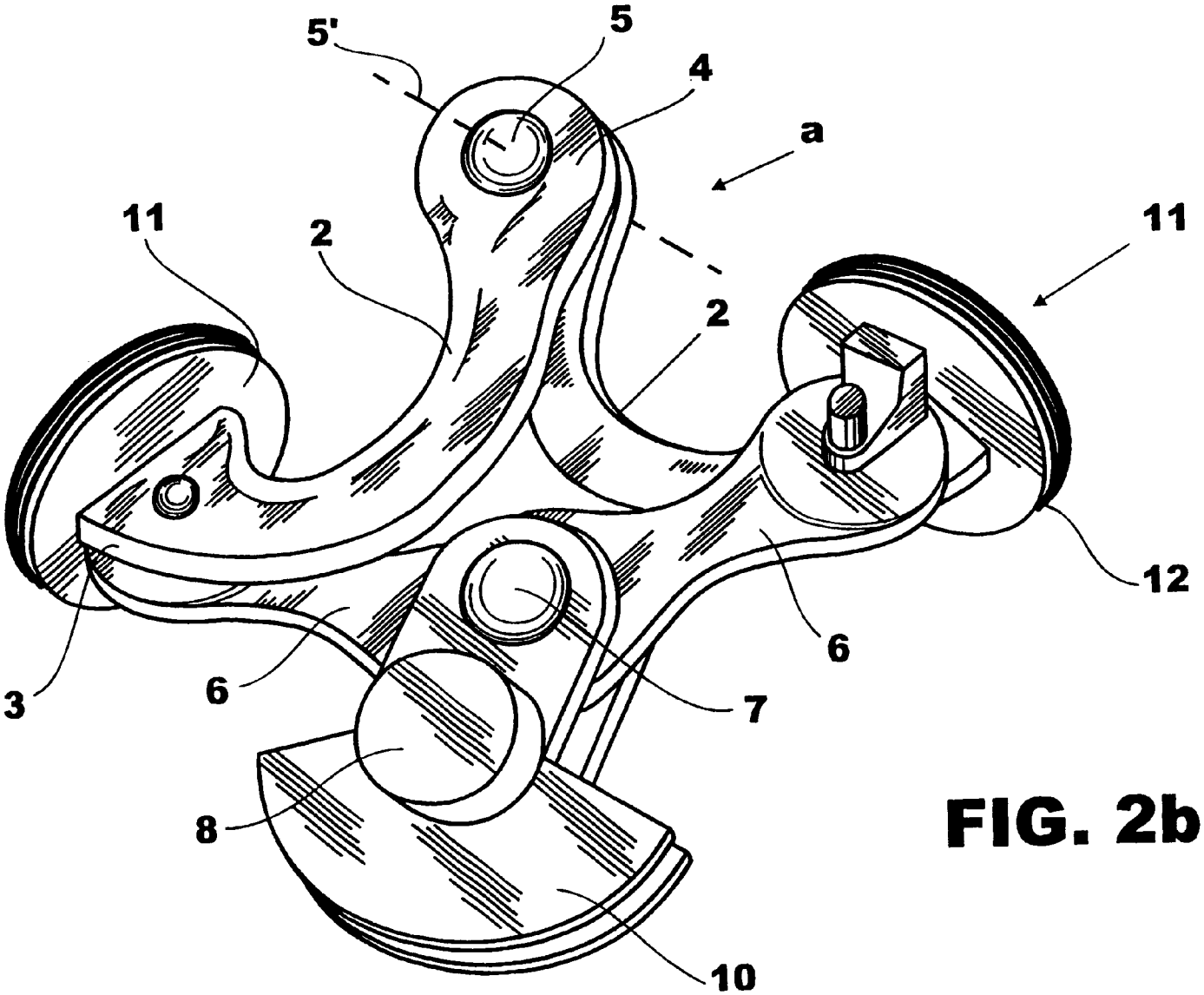
FIG. 2*b* is a perspective view of the pendulum mechanism detached from the engine block in accordance with the present invention.
Figure 3:
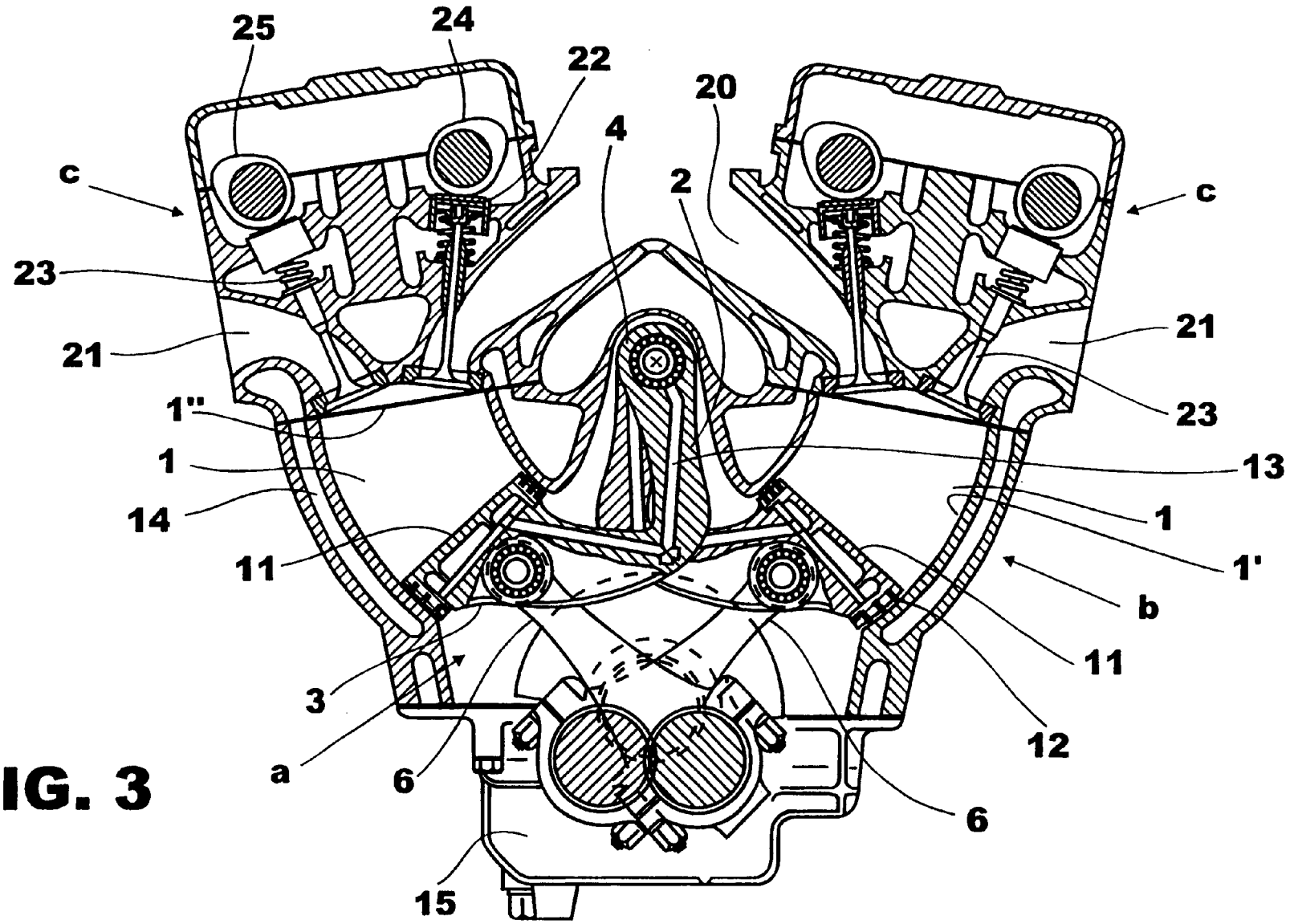
FIG. 3 is a longitudinal section of the pendulum mechanism in a variation adopted for its operation as a combustion engine in accordance with the present invention.

Several embodiments of the present invention have been designed for the connecting rods 6 and the crankshaft 8. In one embodiment, each connecting rod 6 is mounted on the respective bearing journal 7 thereof, as shown in FIG. 3. In a further embodiment, both connecting rods 6 are mounted on the same bearing journal 7, as shown in FIG. 2*b*.

Several alternatives are also appropriate for the mounting axes 5 of the pendulum arms 2. In all cases each mounting axis 5 shall mate with the centerline axis 5' around which the respective toroidal shaped cylinder 1 is positioned or originated. In a preferred embodiment, both pendulum arms 2 share a single mounting axis 5, but there are other embodiments wherein each pendulum arm 2 has its own axis 5, and both axes 5 are coaxial to one another.

The present invention contemplates that the central mounting axis 5 may be a single axis which pivotally anchors the pendulum arms for cooperation with the toroidal shaped cylinders. However, it is within the scope of the present invention that each toroidal shaped cylinder may have its own associated central mounting axis positioned within the housing block which pivotally anchors a pendulum arm for cooperation with its respective toroidal shaped cylinder. Accordingly, a geometrical relation exists between a respective cylinder and its respective central mounting axis 5 of the pendulum arm 2 because the generation centerline axis 5' of the cylinder coincides with its own central mounting axis for the pendulum arm.

Given that the mechanism above described is modular, other embodiments are possible and within the scope of the present invention wherein one or more pendulum mechanisms (a) share the same housing block (b) have been provided. In another variation, pendulum mechanisms (a) are radially arranged, while in another embodiment, two or more pendulum mechanisms (a) are aligned one after the other and mounted along the crankshaft 8.

In still another embodiment, the toroidal shaped cylinders 1 of the same mechanism (a) may have different diameters. Thus, the plunger or pistons 11 which mates with the respective cylinder 1 to the plunger in which it operates must have a diameter similar with the cylinder diameter to provide the sealing function between the piston 11 and the cylinder 1. As the mounting axis 5 of each pendulum arm 2 coincides with the centerline axis 5' around which its' respective toroidal shaped cylinder 1 is spatially positioned, the swinging motion of the arm 2 is performed without the plungers 11 coming in contact with the walls 1' of the toroidal shaped cylinders 1. In these walls 1', only the rings 12 of plunger 11 make sliding contact with the cylinder.

As the toroidal cylinders 1 are arranged on each side of the block (b) with the connecting rods 6 arranged in a "V" layout over the crankshaft 8, the operation of the mechanism (a) is highly balanced and is not subject to great mechanical efforts. This also permits reduced relative size of the plunger 11, as well as by the presence of first cooling lines 13 intended for the plungers 11 and second cooling lines 14, which are designed for the toroidal shaped cylinders 1, which pass through the block walls (b).

As shown in FIG. 3, the present mechanism (a) may be provided with valve means in the head 1" of the toroidal shaped cylinder 1, in the plungers 11 or in head 1" simultaneously. When this pendulum mechanism (a) is employed as a combustion engine, valve devices (c) are mounted on the head 1" of the toroidal shaped cylinders 1. These valve devices (c) include both intake 24 and exhaust 25 camshafts, intake valves 22 where the intake lines 20 flow, and exhaust valves 23 with outlet to the exhaust lines 21.

What is claimed is:

1. A balanced modular pendulum mechanism for use in the handling of a gas, including in combination:

a housing block;

a central axis having a centerline therethrough positioned within said housing block;

a pair of toroidal shaped cylinders positioned within said housing block and spaced from said central axis;

a pair of pendulum arms positioned in said housing, each of said arms having one end mounted on said central axis and each having an end opposite said one end which moves in a swinging movement within said respective toroidal shaped cylinder;

a pair of pistons, each mounted to said end opposite said one end of said pendulum arms and structurally arranged to cooperate with said toroidal cylinders to move a gas therein;

a crankshaft positioned in said housing block; and wherein each of said pendulum arms is linked to a connecting rod pivotally connected to said crankshaft to be driven by the same to provide back and forth movement of each of said pistons within said respective cylinders.

2. The balanced modular pendulum mechanism in accordance with claim 1, wherein both of said connecting rods are mounted on the same bearing journal of said crankshaft.

3. The balanced modular pendulum mechanism in accordance with claim 1, wherein both of said connecting rods are mounted on different bearing journals of said crankshaft.

4. The balanced modular pendulum mechanism in accordance with claim 1, wherein said housing block further includes at least a second pair of toroidal shaped cylinders positioned therein and spaced from said central axis, at least a second pair of pendulum arms positioned in said housing with each arm having one end mounted on said central axis and each having an end opposite said one end which moves in a swinging movement within said respective toroidal shaped cylinder of said at least second pair of said cylinders, at least a second pair of pistons, each mounted to said end opposite said one end of said second pair of pendulum arms and structurally arranged to cooperate with said second pair of said toroidal cylinders to move a gas therein, and wherein each of said second pair of pendulum arms is linked to a second connecting rod pivotally connected to said crankshaft to be driven by the same to provide back and forth movement of each of said pistons within said respective cylinders.

5. The balanced modular pendulum mechanism in accordance with claim 1, wherein said pistons are fixed to said movable ends of said pendulum arms.

6. The balanced modular pendulum mechanism in accordance with claim 1, wherein said pendulum arms are square in cross-section.

7. The balanced modular pendulum mechanism in accordance with claim 1, wherein pendulum arms have an internal cooling line for passing a cooling material therethrough to cool the same.

8. The balanced modular pendulum mechanism in accordance with claim 1, wherein each of said toroidal shaped cylinders have a different diameter cross-section from one another, the respective plungers have a diameter cross-section mating with the respective cylinder cross-section.

9. The balanced modular pendulum mechanism in accordance with claim 4, wherein said connecting rods are mounted on different bearing journals of said crankshaft.

10. A balanced modular pendulum mechanism for use in the movement of a gas, including in combination:

a housing block;

a plurality of central axes each having a centerline therethrough positioned within said housing block;

a pair of toroidal shaped cylinders positioned within said housing block and spaced from said central axis;

a pair of pendulum arms positioned in said housing, each of said arms having one end mounted on at least one of said central axis and each having an end opposite said one end which moves in a swinging movement within said respective toroidal shaped cylinder;

a pair of pistons, each mounted to said end opposite said one end of said pendulum arms and structurally arranged to cooperate with said toroidal cylinders to move a gas therein;

a crankshaft position in said housing block; and wherein each of said pendulum arms is linked to a connecting rod pivotally connected to said crankshaft to be driven by the same to provide back and forth movement of each of said pistons within said respective cylinders.

11. The balanced modular pendulum mechanism in accordance with claim 10, wherein the centerline of each of said plurality of central axes are coaxial to one another.

12. The balanced modular pendulum mechanism in accordance with claim 10, wherein the centerline of each of said plurality of central axes are parallel to one another.

13. The balanced modular pendulum mechanism in accordance with claim 10, wherein said housing block further includes at least a second pair of toroidal shaped cylinders positioned therein and spaced from said plurality of central axes, at least a second pair of pendulum arms positioned in said housing with each arm having one end mounted on at least one of said central axis and each having an end opposite said one end which moves in a swinging movement within said respective toroidal shaped cylinder of said at least second pair of said cylinders, at least a second pair of pistons, each mounted to said end opposite said one end of said second pair of pendulum arms and structurally arranged to cooperate with said second pair of said toroidal cylinders to move a gas therein, and wherein each of said second pair of pendulum arms is linked to a second connecting rod pivotally connected to said crankshaft to be driven by the same to provide back and forth movement of each of said pistons within said respective cylinders.

14. The balanced modular pendulum mechanism in accordance with claim 10, wherein said connecting rods are mounted on different bearing journals on said shaft.

15. The balanced modular pendulum mechanism in accordance with claim 10, wherein each of said pendulum arms are square in cross-section.

16. A balanced modular pendulum mechanism for use as a combustion engine for burning a combustible fluid, including in combination:

an engine block;

a central axis having a centerline therethrough positioned within said engine block;

at least a pair of toroidal shaped cylinders positioned within said engine block and spaced from said central axis with one end of said cylinder having valve members providing intake and exhaust of the combustible fluid to each of said cylinders;

at least a pair of pendulum arms positioned in said housing with each arm having one end mounted on said central axis and having an end opposite said one end which moves in a swinging movement within an end opposite said one end of said respective toroidal shaped cylinder;

at least a pair of pistons, each mounted to said end opposite said one end of said pendulum arms and structurally arranged to cooperate with said cylinders to compress the fluid and combust the same therein;

a crankshaft position in said housing block; and wherein each of said pendulum arms is linked to a connecting rod pivotally connected to said crankshaft to drive the same during the back and forth movement of each of said pistons during combustion within said respective cylinders.

17. The balance modular pendulum mechanism in accordance with claim 16, wherein each pair of said connecting rods are mounted on the same bearing journal of said crankshaft.

18. The balanced modular pendulum mechanism in accordance with claim 16, wherein both of said connecting rods are mounted on different bearing journals of said crankshaft.

19. The balanced modular pendulum mechanism in accordance with claim 1, wherein said housing block further includes at least a plurality of central axes having a centerline therethrough positioned therein of pendulum arms.

20. The balanced modular pendulum mechanism in accordance with claim 19, wherein the centerline of each of said plurality of central axes are coaxial to one another.

21. The balanced modular pendulum mechanism in accordance with claim 19, wherein the centerline of each of said plurality of central axes are parallel to one another.

22. The balanced modular pendulum mechanism in accordance with claim 16, wherein said at least one pair of said pendulum arms are square in cross-section.

23. The balanced modular pendulum mechanism in accordance with claim 16, wherein said at least one pair of said pendulum arms have an internal cooling line for passing a cooling material therethrough to cool the same.

* * * * *

UNITED STATES PATENT AND TRADEMARK OFFICE

CERTIFICATE OF CORRECTION

PATENT NO. : 6,382,143 B2
DATED : May 7, 2002
INVENTOR(S) : Eduardo Taurozzi

It is certified that error appears in the above-identified patent and that said Letters Patent is hereby corrected as shown below:

Column 3,
Line 56, delete the word "usefull" and insert -- useful --.

Signed and Sealed this

Nineteenth Day of November, 2002

*Attest:*

*Attesting Officer*

JAMES E. ROGAN
*Director of the United States Patent and Trademark Office*